US011725872B2

(12) United States Patent
Jin

(10) Patent No.: US 11,725,872 B2
(45) Date of Patent: Aug. 15, 2023

(54) SUPPORT FRAME FOR SLIDING ADJUSTMENT SHELVES OF REFRIGERATED CABINET

(71) Applicant: ZHONGSHAN HAILE ELECTRIC APPLIANCE CO., LTD, Guangdong (CN)

(72) Inventor: Jimmy Jin, Zhongshan (CN)

(73) Assignee: ZHONGSHAN HAILE ELECTRIC APPLIANCE CO., LTD, Zhongshan (CN)

( * ) Notice: Subject to any disclaimer, the term of this patent is extended or adjusted under 35 U.S.C. 154(b) by 100 days.

(21) Appl. No.: 17/422,357

(22) PCT Filed: Dec. 12, 2019

(86) PCT No.: PCT/CN2019/124870
§ 371 (c)(1),
(2) Date: Jul. 12, 2021

(87) PCT Pub. No.: WO2020/143389
PCT Pub. Date: Jul. 16, 2020

(65) Prior Publication Data

US 2022/0074646 A1 Mar. 10, 2022

(30) Foreign Application Priority Data

Jan. 12, 2019 (CN) ..... 201920048881.0
May 17, 2019 (CN) ..... 201920710424.5

(51) Int. Cl.
*F25D 25/02* (2006.01)
*A47B 57/34* (2006.01)
*F25D 23/06* (2006.01)

(52) U.S. Cl.
CPC ..... *F25D 25/02* (2013.01); *A47B 57/34* (2013.01); *F25D 23/067* (2013.01)

(58) Field of Classification Search
CPC ..... F25D 25/02; F25D 23/04; F25D 23/067; A47B 57/482; A47B 57/06; A47B 57/08;
(Continued)

(56) References Cited

U.S. PATENT DOCUMENTS 3,885,846 A * 5/1975 Chuang ..... F25D 25/02 211/187
4,614,273 A * 9/1986 Ishii ..... A47B 57/56 211/183

(Continued)

FOREIGN PATENT DOCUMENTS

CN 203687512 U 7/2014
CN 104006598 A 8/2014

(Continued)

OTHER PUBLICATIONS

Mar. 25, 2022 Office Action issued in Indian Patent Application No. 202117032071.

(Continued)

*Primary Examiner* — Hiwot E Tefera
(74) *Attorney, Agent, or Firm* — Oliff PLC

(57) ABSTRACT

A support frame for sliding adjustment shelves of a refrigerated cabinet comprised at least a fixed column, at least a support body and at least a locking unit, the fixed column is provided with a plurality of positioning bosses spaced apart from each other by a predetermined distance along its length direction, the support body can be locked on the positioning boss of the fixed column through the locking unit, and when the locking unit is released, the support body can slide along the fixed column. Thus, the invention has a larger bearing capacity and a more stable structure, and is more durable.

9 Claims, 13 Drawing Sheets

(58) Field of Classification Search
CPC ..... A47B 96/028; A47B 57/265; A47B 57/30; A47B 57/34; A47B 96/025; A47B 57/26; Y10T 292/286; Y10T 292/288
See application file for complete search history.

(56) References Cited

U.S. PATENT DOCUMENTS 4,752,150 A * 6/1988 Salice ..... F16B 12/26 403/231
5,338,137 A * 8/1994 Jensen ..... B61D 45/001 211/187
6,062,780 A * 5/2000 Petelka ..... B60P 7/15 410/150
6,074,143 A * 6/2000 Langston ..... B60P 1/00 410/148
2008/0035592 A1* 2/2008 Yang ..... A47B 57/26 211/153
2010/0060124 A1* 3/2010 Kang ..... F25D 25/04 312/408
2010/0060125 A1* 3/2010 Kang ..... A47B 57/06 312/408
2010/0117502 A1* 5/2010 Kang ..... F25D 25/02 211/134
2010/0270251 A1* 10/2010 Mejac ..... A47B 57/265 211/134
2012/0018435 A1* 1/2012 Kim ..... F25D 23/04 220/592.02
2012/0293056 A1* 11/2012 Kim ..... F25D 23/04 312/405.1
2014/0042886 A1* 2/2014 Baldo ..... F25D 23/028 312/405.1
2014/0062283 A1* 3/2014 Baldo ..... F16M 13/022 312/405.1
2016/0003520 A1* 1/2016 Wang ..... F25D 23/067 312/405.1
2016/0161669 A1* 6/2016 Lee ..... F25D 25/02 362/621
2017/0159992 A1* 6/2017 Eom ..... F25D 23/04
2017/0284729 A1* 10/2017 Lim ..... F25D 23/04
2018/0128538 A1* 5/2018 Jang ..... A47B 96/025
2019/0075924 A1* 3/2019 Nuss ..... F25D 25/02

FOREIGN PATENT DOCUMENTS

CN 104812269 A 7/2015
CN 209484929 U 10/2019
CN 209877464 U 12/2019

OTHER PUBLICATIONS

Mar. 2, 2022 Office Action issued in Russian Patent Application No. 2021119960/10(041955).
Mar. 20, 2020 International Search Report issued in International Patent Application No. PCT/CN2019/124870.
Mar. 20, 2020 Written Opinion issued in International Patent Application No. PCT/CN2019/124870.

* cited by examiner

SUPPORT FRAME FOR SLIDING ADJUSTMENT SHELVES OF REFRIGERATED CABINET

FIELD OF THE INVENTION

The invention relates to the field of shelf buckles of a refrigerator, and in particular to a support frame for sliding adjustment shelves of a refrigerated cabinet.

BACKGROUND OF THE INVENTION

At present, the shelves of a refrigerated cabinet are usually clamped or embedded on metal or plastic supports of both sides of the rails, while it is difficult to install these shelves and supports, and it is hard to accurately move them to new positions, especially for disassembly and reassembly of the supports. For instance, the Chinese patent document CN 203687512U discloses an adjustable rack and refrigeration equipment. The adjustable rack includes a fixed frame provided with a plurality of positioning holes and a bearing frame slidably connected to the fixed frame. The bearing frame is provided with an elastic clamping tongue inserted into the positioning hole. By slidably connecting the bearing frame to the fixed frame, a user needs to simply toggle the elastic clamping tongue to detach the elastic clamping tongue from the positioning hole when needing to adjust the bearing frame, so that the bearing frame can freely slide on the fixed frame, and after the position is adjusted, the elastic clamping tongue is released and is inserted into the positioning hole at a corresponding position under the action of its elastic force, realizing re-fixing of the bearing frame.

This adjustable rack in the existing technology presents the following shortages when in use: 1, the fixed frame is provided with a plurality of positioning holes into which the elastic clamping tongue is inserted, so as to realize fixing of the bearing frame; when items having a large weight are placed on the bearing frame, the positioning holes are easily deformed due to a low strength, affecting the service life of the fixed frame; 2, the positioning holes have an unstable structure and a small bearing capacity, and are easily damaged; 3, because of the design defects, the structure of the bearing frame for supporting the shelf is simple and has a small bearing capacity; consequently, the shelf is easy to slide down from the bearing frame, causing the items to fall down and causing danger; and 4, the bearing frame is easily loosened when it is not moved in place and the elastic clamping tongue cannot be completely inserted into the positioning hole of the fixed frame, or when the bearing frame stays stationary for a long time, the elastic clamping tongue is also easily loosened due to replacing the items constantly, and the items are easy to fall down together with the bearing frame, thus causing danger.

SUMMARY OF THE INVENTION

The invention overcomes the shortages of the above technology, and provides a support frame for sliding adjustment shelves of a refrigerated cabinet, which has a larger bearing capacity and a more stable structure, and is more durable.

In order to realize the above object, the invention adopts the following technical solutions.

A support frame for sliding adjustment shelves of a refrigerated cabinet, comprising at least a fixed column, at least a support body and at least a locking unit, the fixed column is provided with a plurality of positioning bosses spaced apart from each other by a predetermined distance along its length direction, the support body can be locked on the positioning boss of the fixed column through the locking unit, and when the locking unit is released, the support body can slide along the fixed column.

As an improvement of the invention, the support body is provided with a support part, and the support part is "M" shaped, "⊔" shaped or "]" shaped.

As an improvement of the invention, a limiting part is provided at one side of the support part close to the fixed column for preventing the support body from sliding upward.

As an improvement of the invention, a first guide part is provided at one side of the support part close to the fixed column, and the positioning boss is provided with a second guide part corresponding to the first guide part.

As an improvement of the invention, the support body is provided with a support part which includes a recess arranged on the support body, a cover is provided on the recess to cover an upper opening of the recess, and the cover is in snap-fit with two side walls of the recess.

As an improvement of the invention, the locking unit includes a pressing engagement member, a rotating bolt and at least an elastic member; the pressing engagement member is connected with the support body through the rotating bolt, and the pressing engagement member includes a pressing part, a body part and a clamping part; the support body has a tongue part, the body part is in contact with the tongue part, a rear surface of the pressing part leans against the support body through the elastic member, and when the support body approaches the positioning boss, the clamping part can stretch into a positioning space formed by the tongue part and the positioning boss, thereby the support body is locked.

As an improvement of the invention, the elastic member is a spring; the rear surface of the pressing part is provided with at least a convex column, at least an annular recess is formed in the position of the support body opposites to the rear surface of the pressing part, and the spring is disposed between the convex column and the annular recess.

As an improvement of the invention, the support body is provided with a locking mechanism for maintaining a lock state of the locking unit.

As an improvement of the invention, the locking mechanism includes at least a support body locking hole arranged on the support body and at least a locking unit locking hole arranged on the pressing engagement member of the locking unit and overlapped with the support body locking hole in the lock state of the locking unit, at least a locking latch is inserted between the support body locking hole and the locking unit locking hole to realize locking, and the position of the rotating bolt is not located on the same axis as the position of the locking latch.

As an improvement of the invention, the locking latch includes an arc pin with a rear end being bent and extending to form a handle, and the support body is provided with a limiting protrusion to limit the handle after the locking latch is inserted into the support body locking hole and the locking unit locking hole.

As an improvement of the invention, one end of the rotating bolt is provided with striations.

As an improvement of the invention, the fixed column is provided with at least a guide rail, the support body is provided with at least a first chute correspondingly matched with the guide rail; and the guide rail slides into the first chute so as to realize sliding of the support body on the fixed column.

As an improvement of the invention, one side of the fixed column that having the positioning bosses is printed with sorting numbers for the positioning bosses through silk printing or UV printing.

The invention has the following beneficial effects:

1. The fixed column is provided with the positioning bosses and is locked at one of the positioning bosses through the locking unit so as to realize fixing of the support body, compare to the positioning hole, the fixed column in the invention is in surface contact with the locking unit, so that the bearing capacity becomes larger, it is less prone to deformation or cracking, and the fixed column is more durable, thereby prolonging the service life of the fixed column. 2. The positioning bosses are formed on the fixed column by cold working technology, having stronger anti-deformability and higher strength; thus, the positioning bosses have the better stability and larger bearing capacity and are not easy to damage. 3. The support frame is provided with the support part for supporting a shelf, the support part can clamp the shelf, so that the shelf is not easy to slide down from the support frame, resulting better stability and better safety. 4. The invention can further provide on the support body the locking mechanism for maintaining the lock state of the locking unit, lock the support body and the locking unit in the lock state by the locking latch, prevent the pressing engagement member of the locking unit from detaching from the positioning space formed by the tongue part and the positioning boss, and the weighing stability is improved. 5. The support body of the invention can further be provided with a recess as a support, a shelf bar of the shelf may be defined in the recess, and the cover covers the recess, so that the shelf bar of the shelf is not easy to slide out of the recess, realizing advantages that the shelf bar is not easy to slide out, the shelf is not easy to fall off during use, adjustment or transportation, and it is more safe and reliable when using.

DETAILED DESCRIPTION OF THE INVENTION

Figure 17:
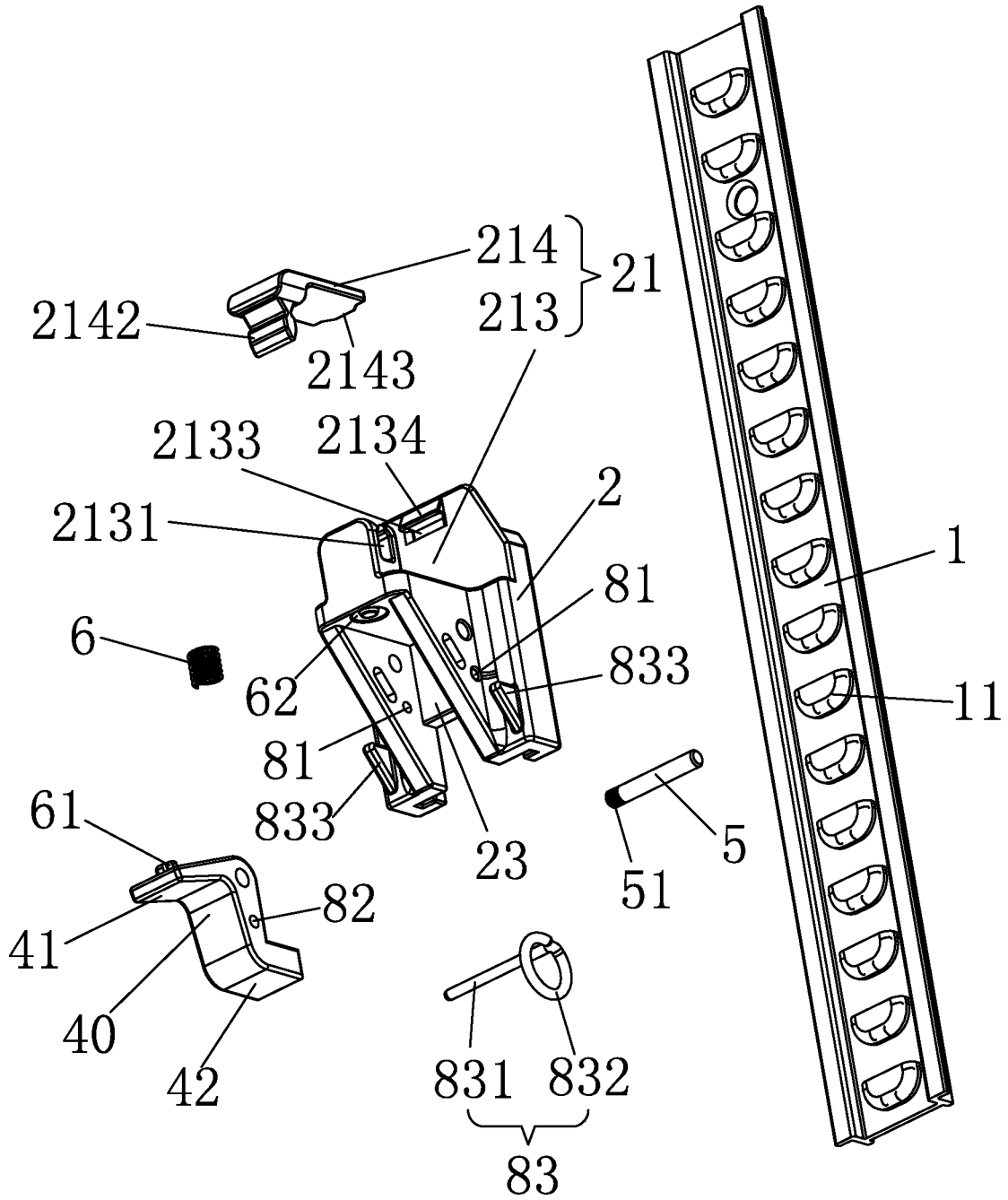
FIG. 17 is a perspective exploded view of FIG. 16.

Further detailed description is made below with reference to the accompanying drawings and embodiments of the invention:

As shown in FIG. 1 to FIG. 10, FIG. 1 to FIG. 10 disclose an implementation of embodiment I of a support frame for sliding adjustment shelves of a refrigerated cabinet. The support frame for sliding adjustment shelves of a refrigerated cabinet, comprising at least a fixed column 1, at least a support body 2 and at least a locking unit 3, the fixed column 1 is provided with a plurality of positioning bosses 11 spaced apart from each other by a predetermined distance along its length direction, the support body 2 can be locked on the positioning boss 11 of the fixed column 1 through the locking unit 3. In the invention, the locking unit 3 includes a pressing engagement member 4, a rotating bolt 5 and at least an elastic member 6, the pressing engagement member 4 is connected with the support body 2 through the rotating bolt 5. In this embodiment, the pressing engagement member 4 includes a pressing part 41, a body part 40 and a clamping part 42. The support body 2 has a tongue part 23, the body part 40 is in contact with the tongue part 23, a rear surface of the pressing part 41 leans against the support body 2 through the elastic member 6. The clamping part 42 is formed by bending the body part 40 backward, when the support body 2 approaches the positioning boss 11, the clamping part 42 can stretch into a positioning space 7 formed by the tongue part 23 and the positioning boss 11, thereby locking the support body 2. When the locking unit 3 is released, the support body 2 can slide along the fixed column 1. In this embodiment, when the pressing part 41 is pressed, i.e., the locking unit 3 is released, the clamping part 42 exits the positioning space 7 so as to realize unlocking, and the support body 2 can slide along the fixed column 1. In the invention, preferably, as shown in FIG. 17, one end of the rotating bolt 5 is provided with striations 51. The rotating bolt 5 is tightly match with the striations 51, so that double insurance is formed to prevent the rotating bolt 5 from being detached.

In the invention, the positioning boss 11 is integrally formed by the fixed column 1. Specifically, in embodiment I, the positioning boss 11 is formed on the fixed column 1 by cold working technology, having strong anti-deformability and higher strength. Certainly, the positioning boss 11 can alternatively be additionally disposed on the fixed column 1. This is not limited here.

Figure 1:
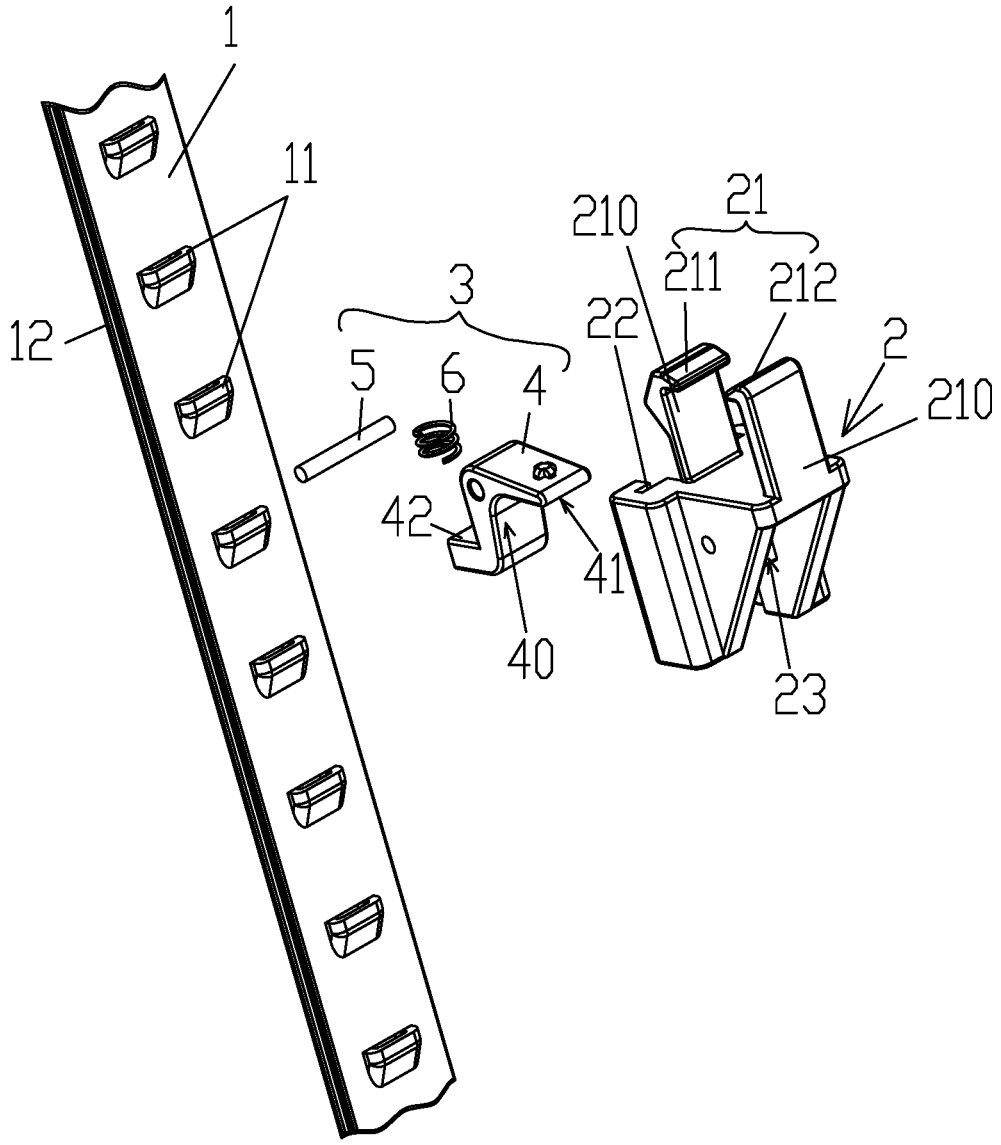
FIG. 1 is a perspective exploded view of embodiment I of the invention.
Figure 2:
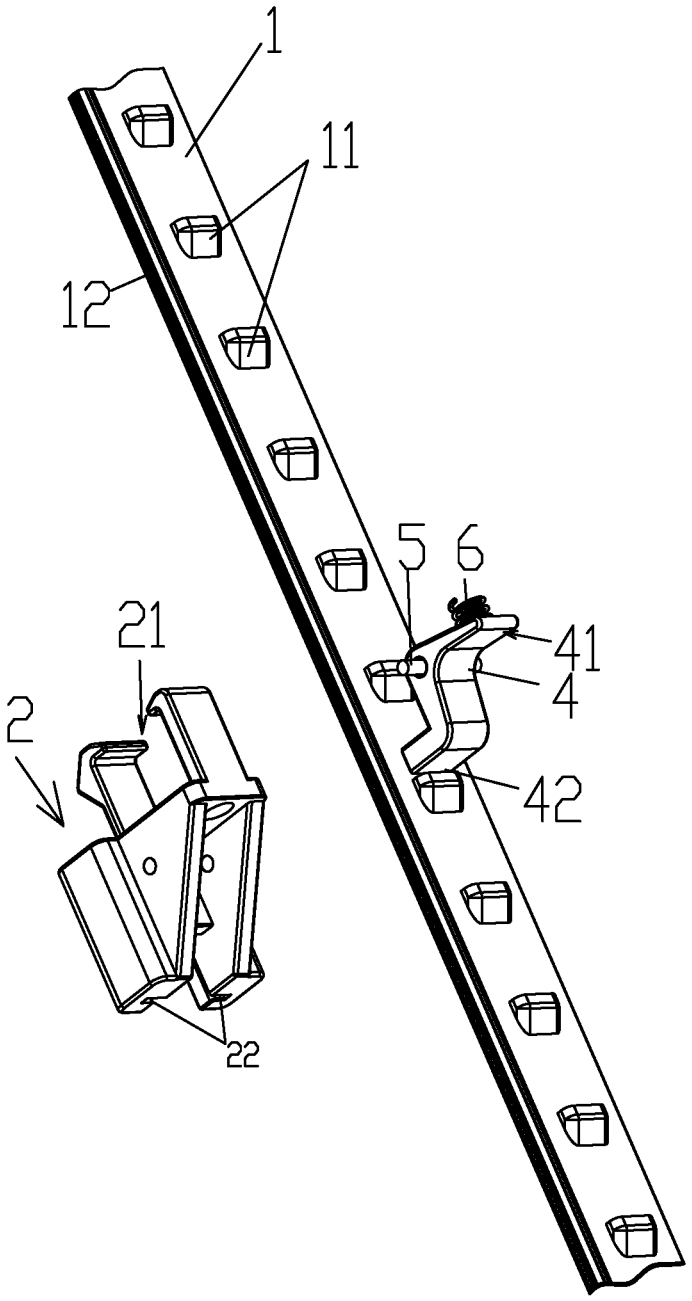
FIG. 2 is a partially combined perspective view of FIG. 1.
Figure 3:
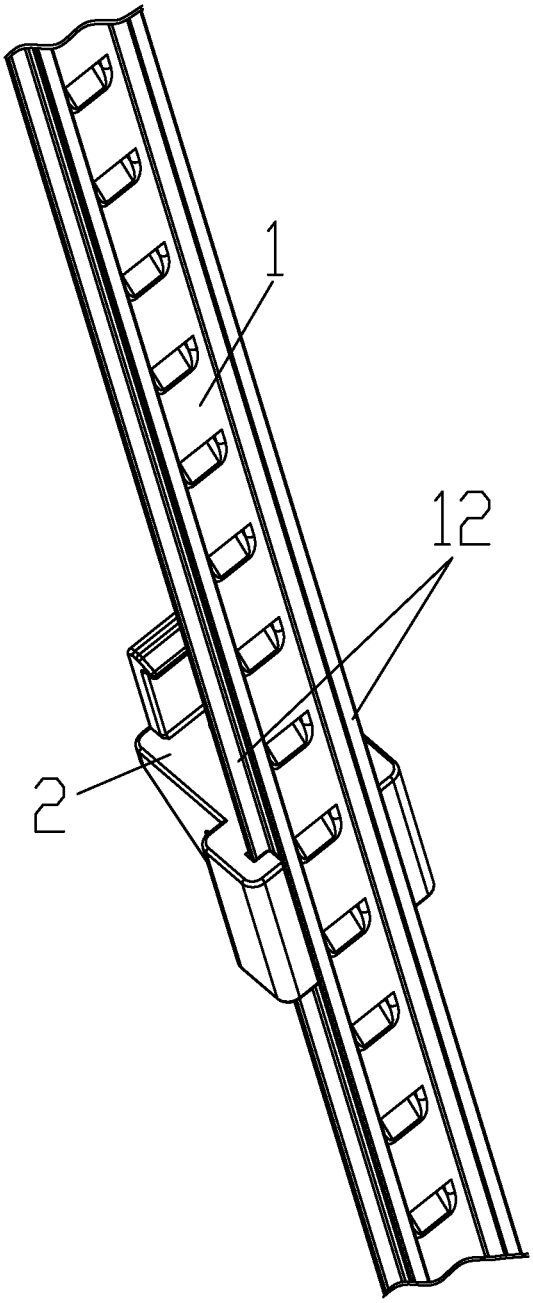
FIG. 3 is a completely combined perspective view of FIG. 1.
Figure 4:
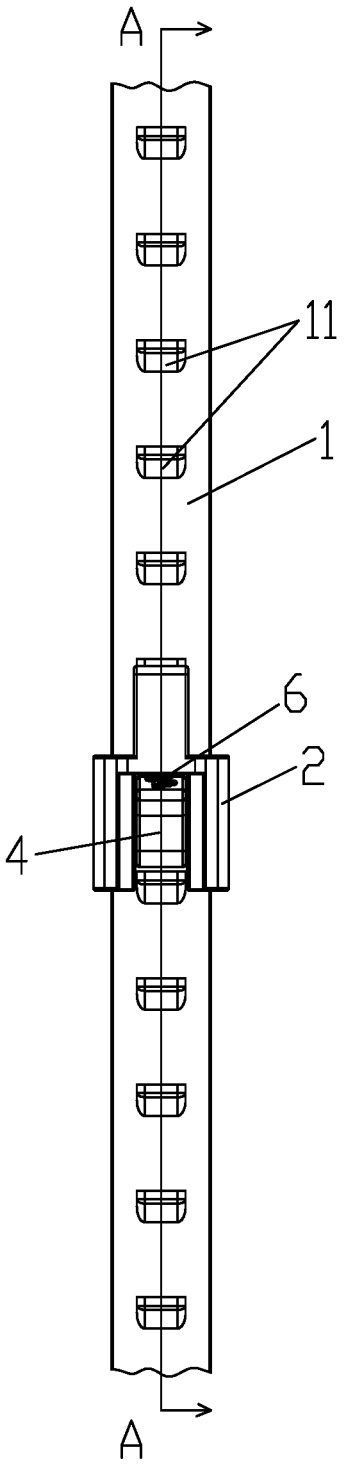
FIG. 4 is a front view of FIG. 3.
Figure 5:
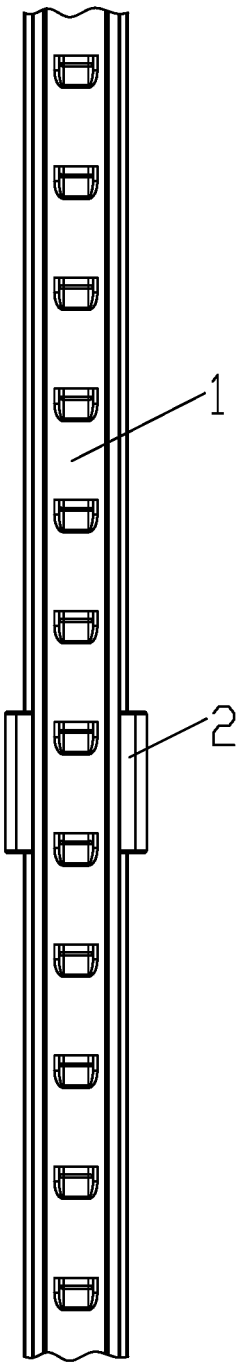
FIG. 5 is a rear view of FIG. 3.
Figure 6:
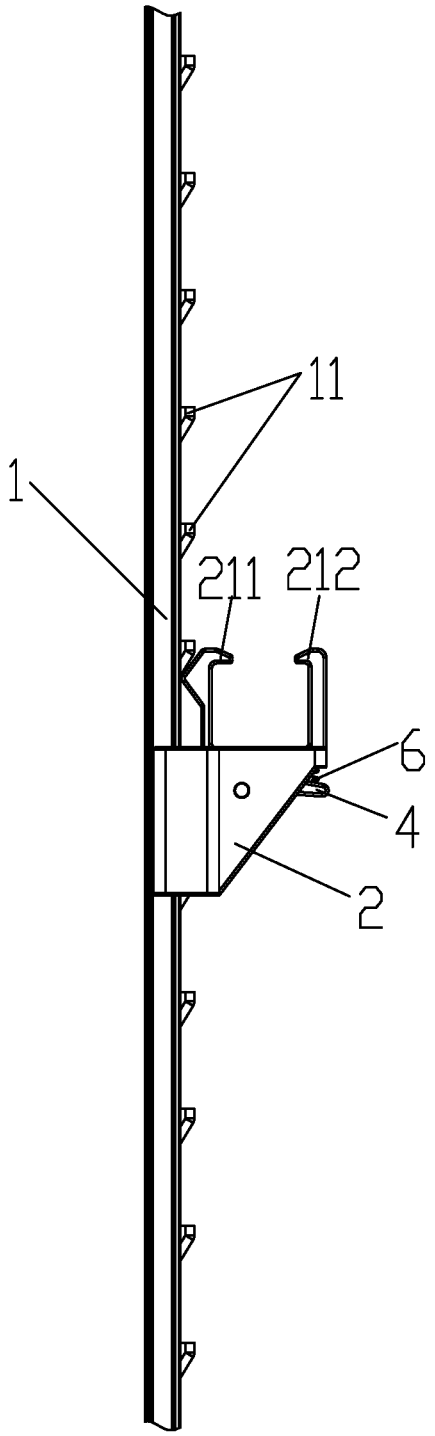
FIG. 6 is a side view of FIG. 3.
Figure 7:
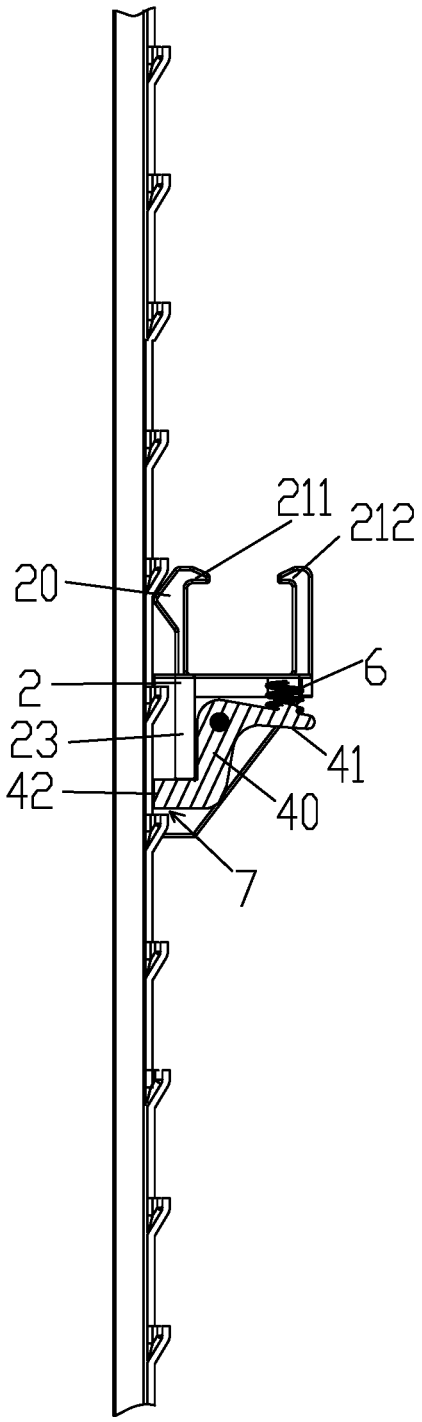
FIG. 7 is a section view in an A-A direction in FIG. 4.
Figure 8:
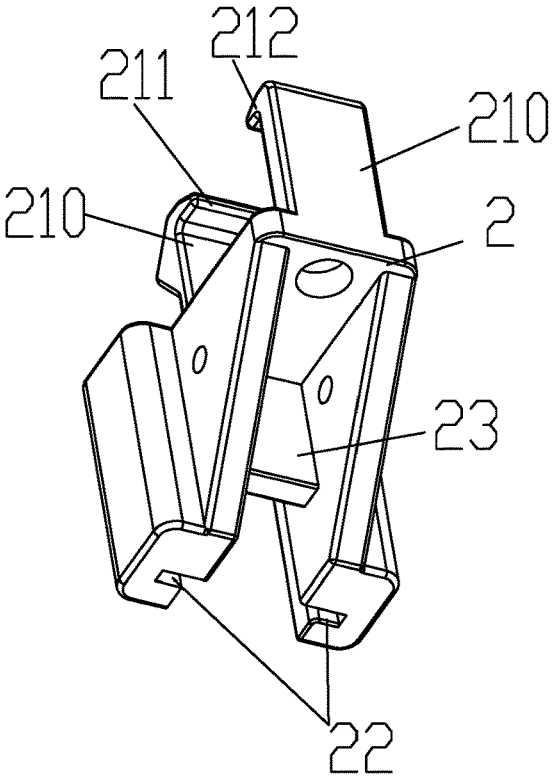
FIG. 8 is a perspective view of a support body of embodiment I of the invention.
Figure 9:
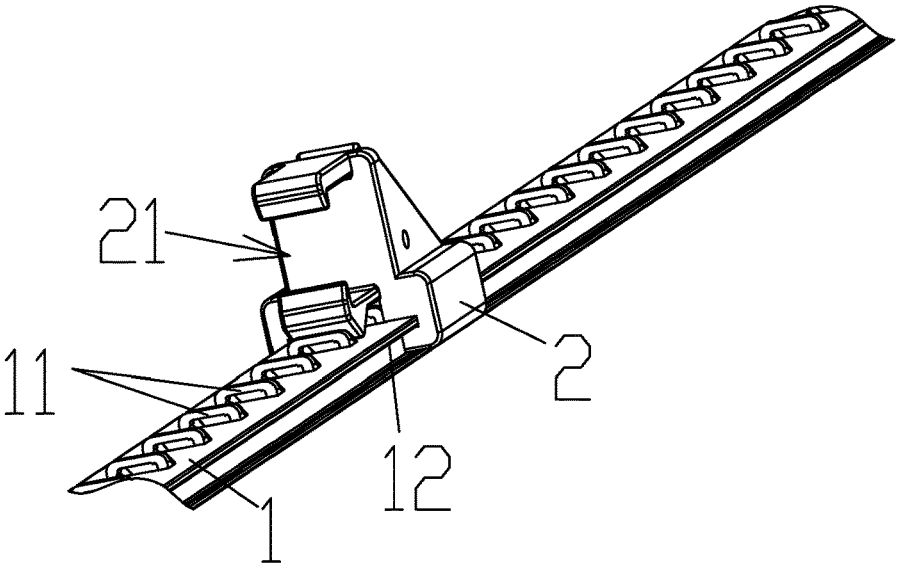
FIG. 9 is another perspective view of FIG. 3.
Figure 10:
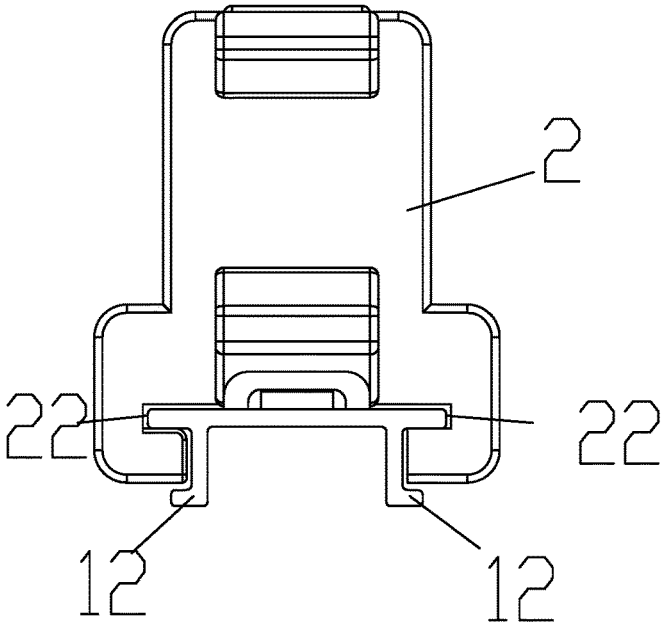
FIG. 10 is a top view of FIG. 9.

In the invention, preferably, the support body 2 is provided with a support part 21 which is "M" shaped or "||" shaped. The "| |" shape indicates that the support part 21 includes two parallel uprights 210. In embodiment I, the support part 21 is used for supporting a shelf (not shown in the figure) of the refrigerated cabinet. In embodiment I, the support part 21 is "M" shaped (as shown in FIG. 6 or 7). In embodiment I, the support part 21 includes two uprights 210 and two fastening parts positioned on the two uprights 210 respectively, a first fastening part 211 and a second fastening part 212. The length of each of the first fastening part 211 and the second fastening part 212 is equal to the upright 210 where it is positioned. The M shaped support part 21 has a better stability which can prevent the shelf from falling, and is safer and more reliable when using.

In the invention, preferably, the fixed column 1 is provided with at least a guide rail 12, the support body 2 is provided with at least a first chute 22 correspondingly matched with the guide rail 12. Moreover, as can be known from FIG. 10, an upper and a lower horizontal contact surfaces are provided between the guide rail 12 and the first chute 22. Double contact surfaces enable the guide rail 12 to be more smoothly and stably matched with the support body 2, so that up and down adjustment is smoother and more stable, realizing double insurance of stable bearing and safety. Furthermore, the double contact surfaces can further increase a contact area of the support body 2 and the guide rail 12, to make the up and down adjustment more stable, so that the phenomenon of derailing is not likely to occur in the sliding process. The first chute 22 is correspondingly matched with the guide rail 12, the guide rail 12 slides into the first chute 22 so that the support body 2 slides on the fixed column 1. When the pressing part 41 is pressed, the locking unit 3 is released, the clamping part 42 exits the positioning space 7 so as to realize unlocking, and the support body 2 can slide along the fixed column 1.

In the invention, preferably, the elastic member 6 is an elastic sheet or a spring. In embodiment I, the elastic member 6 is selected to be a spring. In the invention, preferably, as shown in FIG. 17, a rear surface of the pressing part 41 is provided with at least a convex column 61, at least an annular recess 62 is provided in a position of the support body 2 opposite to the rear surface of the pressing part 41. The spring is disposed between the convex column 61 and the annular recess 62 to further define connection of two ends of the spring and prevent the spring from falling off. Meanwhile, the spring is made of high-quality 304 stainless steel. The pressing service life thereof is tested for more than 50,000 times.

In the invention, preferably, a limiting part 20 is provided at one side of the support part 21 close to the fixed column 1 for preventing the support body 2 from sliding upward. In this embodiment, the limiting part 20 is a protrusion, and certainly it can alternatively be other structure which can prevent the support body 2 from sliding upward. When the support body 2 is locked, the protrusion 20 can prevent the support body 2 from sliding upward. Certainly, in this embodiment, when the upward force is large enough to the support body 2, the support body 2 can be driven to move upward even if it is locked.

In the invention, preferably, one side of the fixed column 1 that having the positioning bosses 11 is printed with sorting numbers (not shown in the figures) for the positioning bosses 11 through silk printing or UV printing. So that the sorting numbers are more resistant to scratch and wipe by alcohol, and is clear and easy to read.

Figure 11:
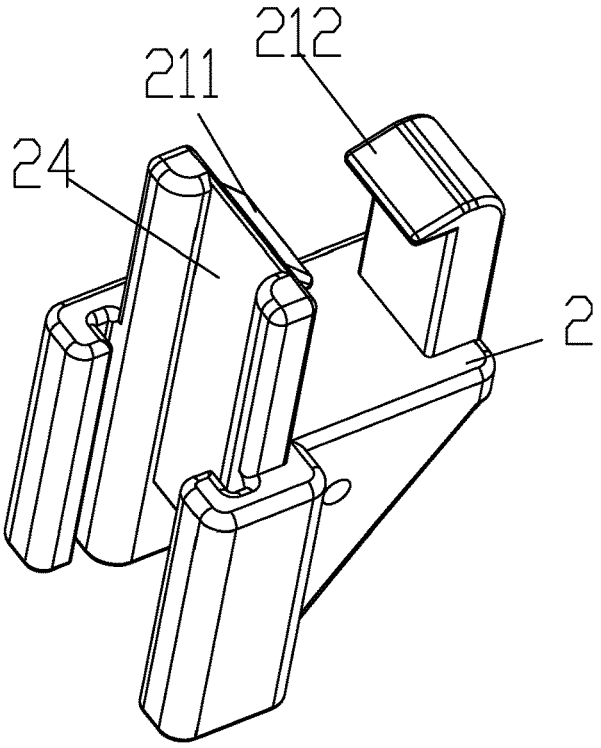
FIG. 11 is a perspective view of a support body of embodiment II.
Figure 12:
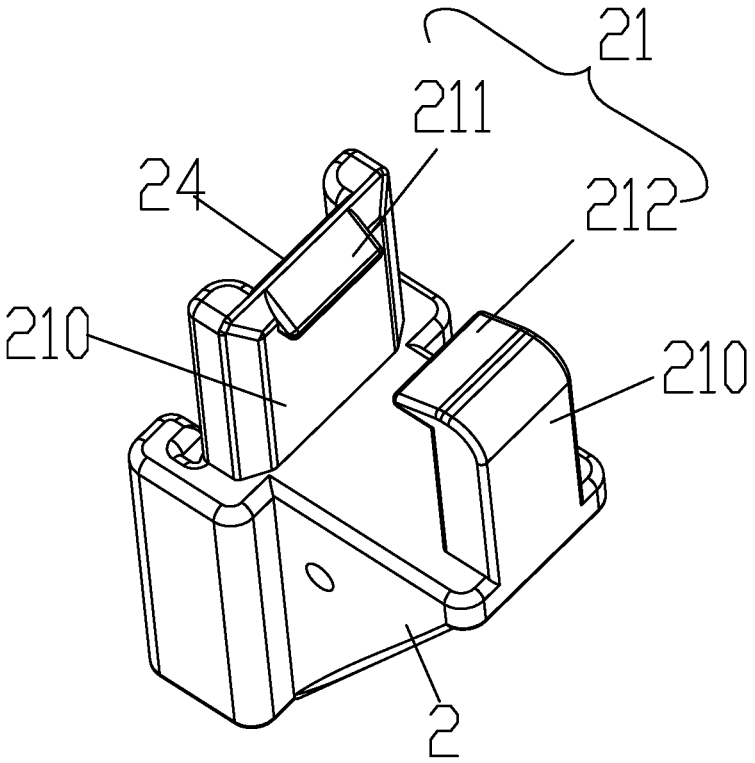
FIG. 12 is another perspective view of FIG. 11.

FIG. 11 and FIG. 12 show an implementation of the support body 2 of embodiment II. Such an implementation has the substantially same structure as the structure of the support body 2 in the implementation of embodiment I, while the differences are as follows, a first guide part 24 is provided at one side of the support part 21 close to the fixed column 1, and the positioning boss 11 is provided with a second guide part corresponding to the first guide part 24. Specifically, in embodiment II, the first guide part 24 is a second chute (or which can be a slide rail), and the second guide part is a slide rail (or which can be a chute, not shown in the figures). The slide rail slides into the second chute, and when the position of the support body 2 needs to be adjusted upward after the locking unit 3 is unlocked, it is more convenient to push the support body 2 upward for adjustment of its position, so that the support body 2 can more easily slide upward along the positioning column 1. Furthermore, in embodiment II, in order to install and remove the shelf on the support part 21 of the support body 2 more conveniently, the support part 21 is M shaped, and includes two fastening parts, a first fastening part 211 or a second fastening part 212. The length of the first fastening part 211 or the second fastening part 212 is smaller than that of the upright 210 where it is positioned. In embodiment II, the length of the first fastening part 211 is smaller than that of the upright 210 where it is positioned, as shown in FIG. 11 and FIG. 12.

Figure 13:
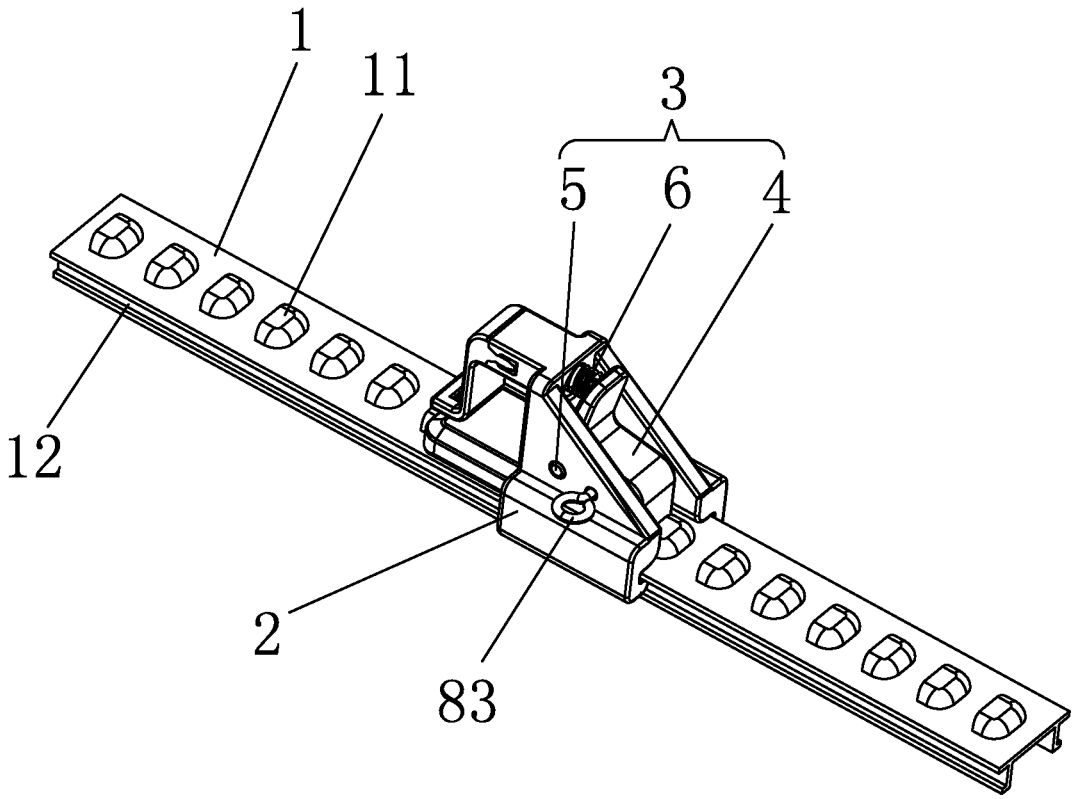
FIG. 13 is a perspective view of the combination of a support body and the fixing column according to embodiment III of the invention.
Figure 14:
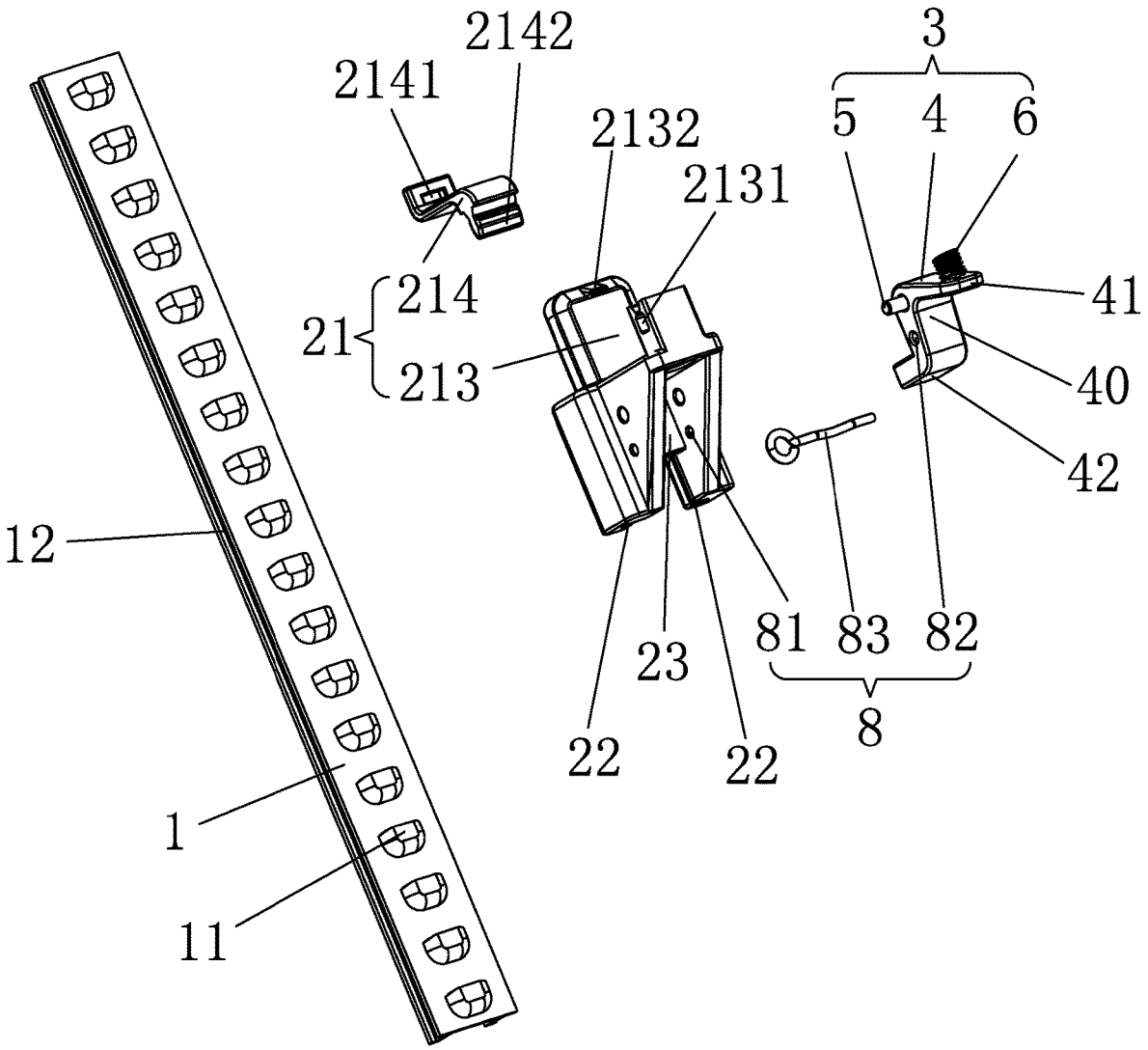
FIG. 14 is a perspective exploded view of FIG. 13.
Figure 15:
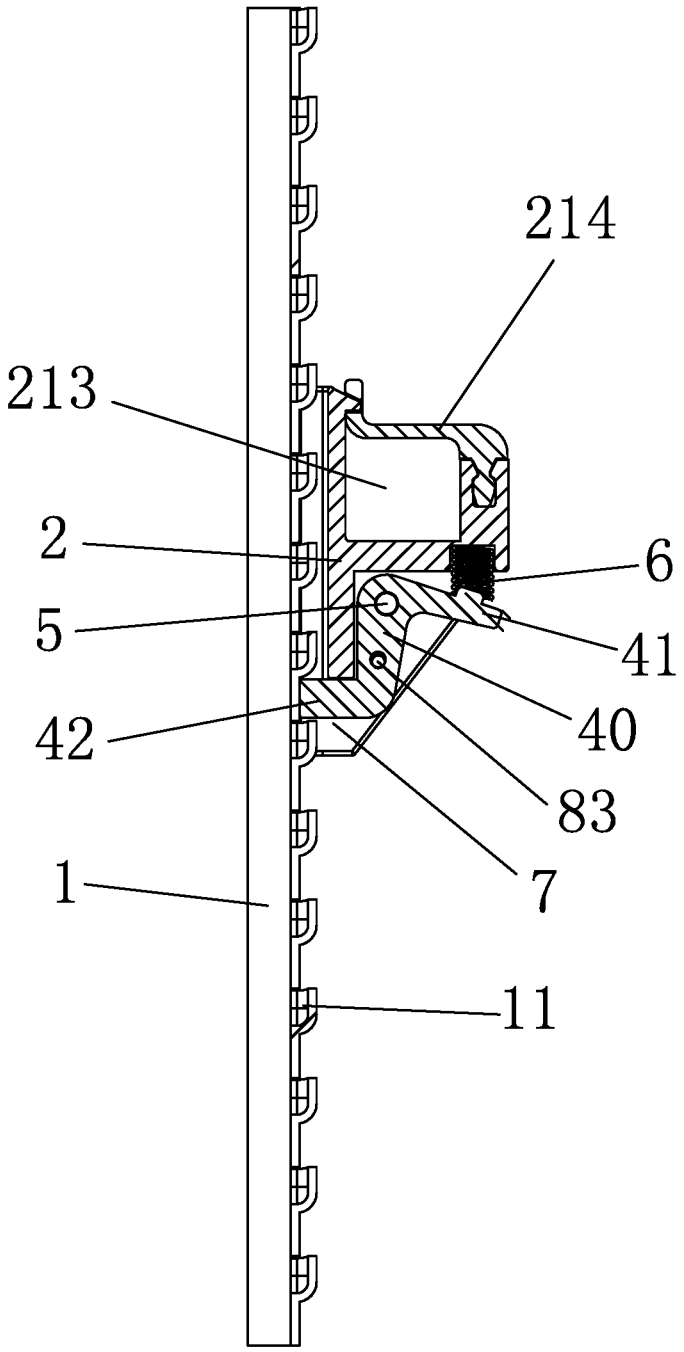
FIG. 15 is a section view of FIG. 13.

FIG. 13 to FIG. 15 are an implementation of embodiment III in which the support body 2 and the fixed column 1 are combined. Such an implementation has the substantially same structure as the structure of the support body 2 in the embodiment II, while the differences are as follows. The support body 2 is provided with a support part 21, the support part 21 includes a groove 213 provided on the support body 2 and which is formed by two parallel uprights 210. At least a cover 214 is provided on the groove 213 to cover an upper opening of the groove 213. The cover 214 is in snap-fit with two side walls of the groove 213. After the shelf (not shown in the figures) of the refrigerated cabinet is placed in the groove 213, the opening of the groove 213 can be sealed by the cover 214, so that the shelf bar of the shelf is not easy to slide out of the groove 213. Specifically, in embodiment III, at least a slot 2131 and at least a clamping block 2132 provided on two side walls of the groove 213 are in snap-fit with at least an insert block 2142 and at least a bayonet 2141 provided at two ends of the cover 214 respectively.

Figure 16:
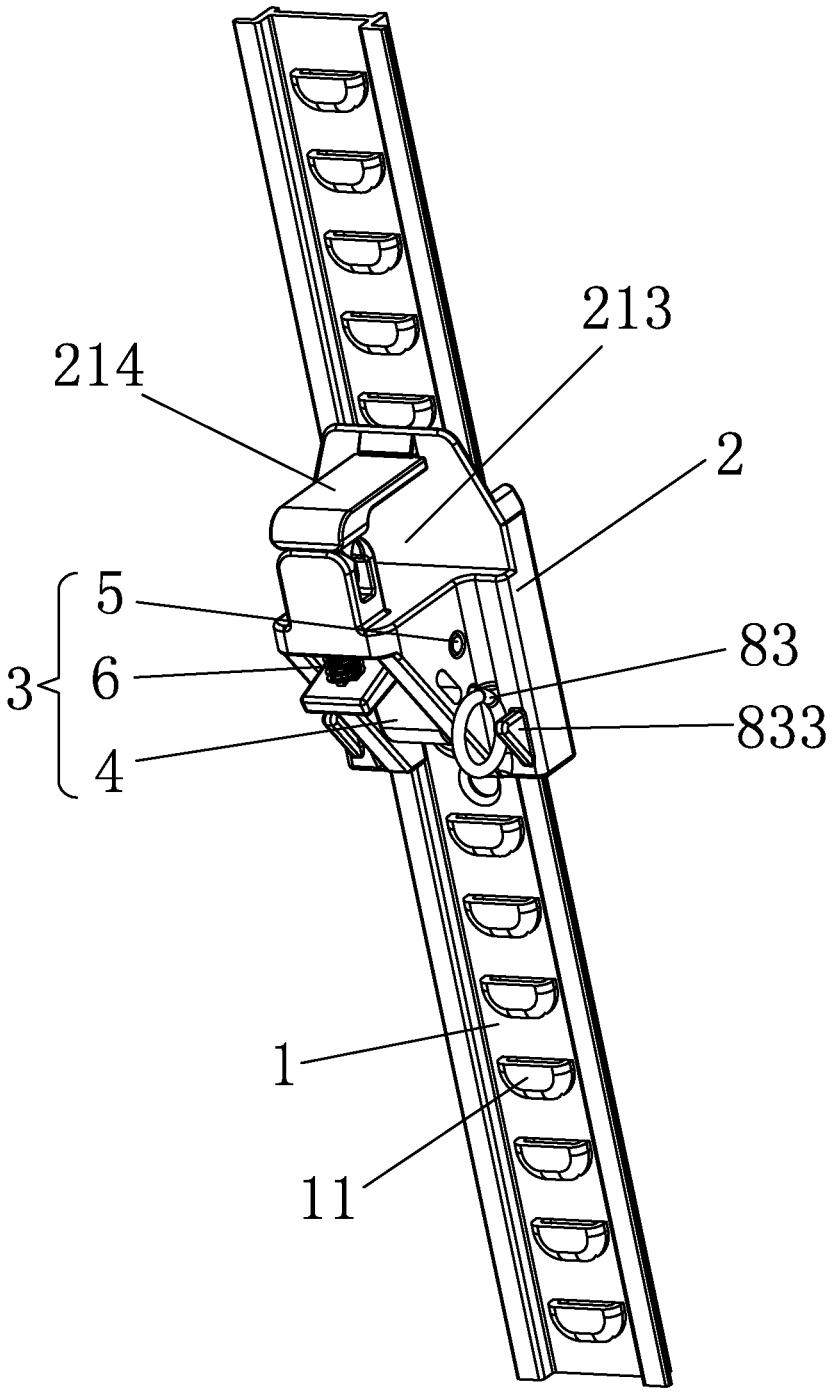
FIG. 16 is a perspective view of the combination of a support body and the fixing column according to embodiment IV of the invention.

FIG. 16 and FIG. 17 are an implementation of embodiment IV in which the support body 2 and the fixed column 1 are combined. Such an implementation has the substantially same structure as the structure of the support body 2 in the implementation of embodiment III, while the differences are as follows. The cover 214 is in snap-fit with two side walls of the groove 213. Specifically, in embodiment IV, at least a slot 2131 and at least an indentation 2133 provided on two side walls of the groove 213 are in snap-fit with at least an insert block 2142 and at least a bump 2143 provided at two ends of the cover 214 respectively, and an outside of the indentation 2133 is provided at least a positioning bump 2134 connected with the positioning cover 214.

In embodiments I to IV of the invention, the support body 2 is provided with a locking mechanism 8 for maintaining a lock state of the locking unit 3. FIG. 13 to FIG. 15 are an implementation of the locking mechanism 8. The locking mechanism 8 includes at least a support body locking hole 81 provided on the support body 2 and at least a locking unit locking hole 82 provided on the pressing engagement member 5 of the locking unit 3 and overlapped with the support body locking hole 81 in the lock state of the locking unit 3. At least a locking latch 83 is inserted between the support body locking hole 81 and the locking unit locking hole 82 to realize locking. The position of the rotating bolt 5 is not located on the same axis as the position of the locking latch 83. When the clamping part 42 stretches into the positioning space 1 formed by the tongue part 23 and the positioning boss 11 to lock the support body 2, the support body 2 and the locking unit 3 are in the lock state, and in this state, the support body locking hole 81 and the locking unit locking hole 82 are overlapped, and the locking latch 83 can be inserted to maintain the lock state of the support body 2 and the locking unit 3. When the locking unit 3 needs to be unlocked and moved, the locking latch 43 can be pulled out to press the pressing engagement member 5 of the locking unit 3, so that the clamping part 53 is pushed out from the positioning space 8 to complete unlocking.

FIG. 16 and FIG. 17 are another embodiment of the locking mechanism 8. Such an embodiment has the substantially same structure as the structure of the locking mechanism 8 of the above embodiment, while the differences are as follows. The locking latch 83 includes an arc pin 831, a rear end of the arc pin 831 is bent and extended to form a handle 832. The support body 2 is provided with a limiting protrusion 833 to limit the handle 832 after the locking latch 83 is inserted into the support body locking hole 81 and the locking unit locking hole 82. The arc design of the arc pin 831 of the locking latch 83 causes a certain stress after the locking latch 83 is inserted into the support body locking hole 81 and the locking unit locking hole 82, so that it is not easy to fall off. Meanwhile, the handle 832 formed by bending and extending of the inserted locking latch 83 can be clamped into the limiting protrusion 833 after inserting of the locking latch 83, so as to further prevent falling-off of the locking latch 83.

For those skilled in the art, various other corresponding modifications and variations can be made according to the technical solutions and conceptions described above, while all these modifications and variations shall fall within the protection scope of the claims of the present invention.

The invention claimed is:

1. A support frame for sliding adjustment shelves of a refrigerated cabinet, comprising at least a fixed column, at least a support body and at least a locking unit, the fixed column is provided with a plurality of positioning bosses spaced apart from each other by a predetermined distance along its length direction, the support body can be locked on the positioning boss of the fixed column through the locking unit, and when the locking unit is released, the support body can slide along the fixed column, wherein:

the locking unit includes a pressing engagement member, a rotating bolt and at least an elastic member; the pressing engagement member is connected with the support body through the rotating bolt, and the pressing engagement member includes a pressing part, a body part and a clamping part; the support body has a tongue part, the body part is in contact with the tongue part, a rear surface of the pressing part leans against the support body through the elastic member, and when the support body approaches the positioning bosses, the clamping part can stretch into a positioning space formed by the tongue part and the positioning bosses, thereby the support body is locked, and the elastic member is a spring; the rear surface of the pressing part is provided with at least a convex column, at least an annular recess is formed in the position of the support body opposites to the rear surface of the pressing part, and the spring is disposed between the convex column and the annular recess.

2. The support frame for sliding adjustment shelves of a refrigerated cabinet according to claim 1, wherein the support body is provided with a support part, and the support part is "M" shaped, "⊔" shaped or "⎦" shaped.

3. The support frame for sliding adjustment shelves of a refrigerated cabinet according to claim 1, wherein the support body is provided with a support part which includes a groove arranged on the support body, at least a cover is provided on the groove to cover an upper opening of the groove and the cover is in snap-fit with two side walls of the groove.

4. The support frame for sliding adjustment shelves of a refrigerated cabinet according to claim 1, wherein the support body is provided with a locking mechanism for maintaining a lock state of the locking unit.

5. The support frame for sliding adjustment shelves of a refrigerated cabinet according to claim 4, wherein the locking mechanism includes at least a support body locking hole arranged on the support body and at least a locking unit locking hole arranged on the pressing engagement member of the locking unit and overlapped with the support body locking hole in the lock state of the locking unit, at least a locking latch is inserted between the support body locking hole and the locking unit locking hole to realize locking.

6. The support frame for sliding adjustment shelves of a refrigerated cabinet according to claim 5, wherein the locking latch includes an arc pin with a rear end being bent and extending to form a handle, and the support body is provided with a limiting protrusion to limit the handle after the locking latch is inserted into the support body locking hole and the locking unit locking hole.

7. The support frame for sliding adjustment shelves of a refrigerated cabinet according to claim 1, wherein one end of the rotating bolt is provided with striations.

8. The support frame for sliding adjustment shelves of a refrigerated cabinet according to claim 1, wherein the fixed column is provided with at least a guide rail, the support body is provided with at least a first chute correspondingly matched with the guide rail; and the guide rail slides into the first chute so as to realize sliding of the support body on the fixed column.

9. The support frame for sliding adjustment shelves of a refrigerated cabinet according to claim 1, wherein one side of the fixed column that having the positioning bosses is printed with sorting numbers for the positioning bosses through silk printing or UV printing.

* * * * *